US011488563B2

(12) United States Patent
Jun et al.

(10) Patent No.: US 11,488,563 B2
(45) Date of Patent: Nov. 1, 2022

(54) IMAGE DATA PROCESSING DEVICE AND METHOD OF PROCESSING IMAGE DATA BASED ON A REPRESENTATIVE VALUE OF AN IMAGE

(71) Applicant: SILICON WORKS CO., LTD., Daejeon (KR)

(72) Inventors: Young Jun Jun, Daejeon (KR); Bo Sung Kim, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/190,935

(22) Filed: Mar. 3, 2021

(65) Prior Publication Data

US 2021/0312884 A1 Oct. 7, 2021

(30) Foreign Application Priority Data

Mar. 6, 2020 (KR) ..... 10-2020-0028030

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/0271* (2013.01); *G09G 2320/0646* (2013.01)

(58) Field of Classification Search
None
See application file for complete search history.

(56) References Cited

U.S. PATENT DOCUMENTS

2014/0320546 A1* 10/2014 Lim ..... G09G 3/3291 345/77
2016/0035293 A1* 2/2016 Furihata ..... G09G 5/02 345/694

FOREIGN PATENT DOCUMENTS

| | | | |
|---|---|---|---|
| JP | 4198720 | B2 | 12/2008 |
| JP | 5013581 | B2 | 8/2012 |
| KR | 10-2014-0008036 | A | 1/2014 |
| KR | 10-1840796 | B1 | 3/2018 |
| KR | 10-1969830 | B1 | 8/2019 |

* cited by examiner

*Primary Examiner* — Amr A Awad
*Assistant Examiner* — Donna V Bocar
(74) *Attorney, Agent, or Firm* — Fenwick & West LLP

(57) ABSTRACT

The present disclosure relates to a device and a method for processing image data for driving a display panel. More particularly, it relates to a device and a method to vary the brightness of each pixel according to a representative brightness value of an image.

12 Claims, 11 Drawing Sheets

*FIG. 4*

| | Point1 | Point2 | Point3 | Point4 | Point5 | Point6 | Point7 | Point8 |
|---|---|---|---|---|---|---|---|---|
| Set | 7 | 7 | 7 | 6 | 6 | 6 | 5 | 5 |

*FIG. 5*

| | |
|---|---|
| Point8 value | $1023 - 2^{Point8}$ |
| Point7 value | Point8 value $- 2^{Point7}$ |
| Point6 value | Point7 value $- 2^{Point6}$ |
| Point5 value | Point6 value $- 2^{Point5}$ |
| Point4 value | Point5 value $- 2^{Point4}$ |
| Point3 value | Point4 value $- 2^{Point3}$ |
| Point2 value | Point3 value $- 2^{Point2}$ |
| Point1 value | Point2 value $- 2^{Point1}$ |

*FIG. 6*

| | |
|---|---|
| Point8 value | 991 (1023 – $2^5$) |
| Point7 value | 959 (Point8 value – $2^5$) |
| Point6 value | 895 (Point7 value – $2^6$) |
| Point5 value | 831 (Point6 value – $2^6$) |
| Point4 value | 767 (Point5 value – $2^6$) |
| Point3 value | 639 (Point4 value – $2^7$) |
| Point2 value | 511 (Point3 value – $2^7$) |
| Point1 value | 383 (Point2 value – $2^7$) |

*FIG. 7*

| WAPL \ APL | 1~5 | 6~10 | 11~15 | 16~20 | 21~25 |
|---|---|---|---|---|---|
| 1~5 | Lv1 | Lv2 | Lv3 | Lv4 | Lv5 |
| 6~10 | Lv21 | Lv22 | Lv33 | Lv24 | Lv25 |
| 11~15 | Lv41 | Lv42 | Lv43 | Lv44 | Lv45 |
| 16~20 | Lv61 | Lv62 | Lv63 | Lv64 | Lv65 |
| 21~25 | Lv81 | Lv82 | Lv83 | Lv84 | Lv85 |

• • •

⋮

IMAGE DATA PROCESSING DEVICE AND METHOD OF PROCESSING IMAGE DATA BASED ON A REPRESENTATIVE VALUE OF AN IMAGE

CROSS REFERENCE TO RELATED APPLICATION

This application claims priority from Republic of Korea Patent Application No. 10-2020-0028030, filed on Mar. 6, 2020, which is hereby incorporated by reference in its entirety.

BACKGROUND

1. Field of Technology

The present disclosure relates to a device and a method for processing image data for driving a display panel.

2. Description of the Prior Art

As society becomes more and more information-oriented, the demand for products requiring display devices has increased in various ways. Recently, various display devices such as liquid crystal display (LCD) devices, plasma display panels (PDP), organic light emitting diode display (OLED) devices, or the like, are used.

A display device displays an image on a panel by controlling the brightness of each pixel according to image data received from a host device. A display device comprising pixels emitting light by themselves without using a backlight—for example an organic light emitting display device—may generally control the brightness of each pixel by controlling the level of a driving current supplied to the pixel.

In such a display device, the level of a driving current supplied to a pixel is controlled by an analog voltage, so-called data voltage, converted from image data. Consequently, a display device may control the brightness of a pixel according to image data.

Here, as the brightness of each pixel becomes higher, the power consumption of a display device increases.

In other words, as an image comprises more white or whitish colors, each pixel has a greater brightness and this causes an increase in power consumption of a display device. In addition, this may cause a glare on the display device.

In order to solve such problems, conventionally, brightness values included in image data in a display device are uniformly lowered so that the power consumption may be reduced and the glare may be prevented.

However, when the brightness values included in image data are uniformly lowered, this may also reduce the brightness of images that were not intended and this may cause the deterioration of the image quality.

For example, in a case when an image includes a lot of dark colors, since the brightness values included in image data are uniformly reduced, this may cause the deterioration of the image quality of such an image including a lot of dark colors.

SUMMARY

An aspect of the present disclosure is to provide a technique for changing the brightness of each pixel according to a representative brightness value of an image.

To this end, in an aspect, the present disclosure provides a method of processing image data by a processing device, comprising the steps of: calculating a representative brightness value for input pixel brightness values included in input image data; calculating N (N is a natural value, which is 2 or higher) X-axis point values using N set values; generating a first reference curve using N first Y-axis point values and the X-axis point values and generating a second reference curve using N second Y-axis point values and the X-axis point values; generating a brightness adjustment curve using the first reference curve, the second reference curve, and the representative brightness value; and converting the input pixel brightness values into output pixel brightness values using the brightness adjustment curve.

The method may further comprise a step of transmitting output image data including the output pixel brightness values to a panel driving device.

The input pixel brightness values, the X-axis point values, the first Y-axis point values, the second Y-axis point values, and the output pixel brightness values may be greyscale values.

X-axis coordinate values of the brightness adjustment curve may comprise the input pixel brightness values and Y-axis coordinate values of the brightness adjustment curve may comprise the output pixel brightness values.

The step of generating a first reference curve and a second reference curve may comprise generating a first reference curve by matching the X-axis point values with the first Y-axis point values and calculating values between the X-axis point values by a data interpolation; and generating a second reference curve by matching the X-axis point values with the second Y-axis point values and calculating values between the X-axis point values by the data interpolation.

The set values may comprise indexes of the involutions of 2.

The step of calculating the X-axis point values may comprise calculating an Nth involution value, which is a value of the involution of 2 having an Nth set value as an index, by an operation of shift by the Nth set value, which is the last set value, and calculating an Nth X-axis point value, which is the maximum X-axis point value, by subtracting the Nth involution value from the highest brightness value of a pixel.

The representative brightness value may be less than or equal to a first representative brightness value identified in the first reference curve and equal to or greater than a second representative brightness value identified in the second reference curve.

In the step of generating a brightness adjustment curve, the brightness adjustment curve may be generated by a data interpolation using the first representative brightness value, the second representative brightness value, and the representative brightness value.

In another aspect, the present disclosure provides an image data processing device, comprising: a representative brightness value calculating circuit to calculate a representative brightness value for input pixel brightness values included in input image data; a curve generating circuit to generate a first reference curve by calculating N (N is a natural number, which is 2 or higher) X-axis point values using N set values and using N first Y-axis point values and the N X-axis point values, to generate a second reference curve using N second Y-axis point values and the N X-axis point values, and to generate a brightness adjustment curve using the first reference curve, the second reference curve, and the representative brightness value; and an image data converting circuit to convert the input pixel brightness values into output pixel brightness values using the brightness adjustment curve.

The image data processing device may further comprise an image data transmitting circuit to transmit output image data including the output pixel brightness values to a panel driving device.

The curve generating circuit comprises: a shift operation circuit to calculate values of involutions of 2 having the N set values as indexes by shift operations; a subtraction circuit to calculate an Nth X-axis point value, which is the maximum X-axis point value, by subtracting an Nth involution value, which is a value of involution of 2 having an Nth set value (the last set value among the N set values) as an index, from a highest brightness value of a pixel and to calculate an N−1th X-axis point value by subtracting an N−1th involution value from the Nth X-axis point value; and a data interpolation circuit to generate the first reference curve by matching the X-axis point values with the first Y-axis point values and calculating values between the X-axis point values and to generate the second reference curve by matching the X-axis point values with the second Y-axis point values and calculating values between the X-axis point values.

The data interpolation circuit may generate the brightness adjustment curve by a data interpolation using a first representative brightness value identified in the first reference curve, a second representative brightness value identified in the second reference curve, and the representative brightness value.

The image data processing device may further comprise a memory circuit to store the N set values, the N first Y-axis point values, and the N second Y-axis point values.

The memory circuit may further store a lookup table including a plurality of representative brightness ranges, a plurality of weighted average brightness ranges, and a plurality of representative brightness levels corresponding to the plurality of representative brightness ranges and the plurality of weighted average brightness ranges.

The input pixel brightness values may comprise R greyscale values, which are greyscale values of red (R) sub-pixels, G greyscale values, which are greyscale values of green (G) sub-pixels, and B greyscale values, which are greyscale values of blue (B) sub-pixels and the representative brightness value calculating circuit may calculate a weighted average brightness value by dividing a maximum value, among a first square sum value obtained by summing up square values of the R greyscale values, a second square sum value obtained by summing up square values of the G greyscale values, and a third square sum value obtained by summing up square values of the B greyscale values, by a maximum value among a first sum value obtained by summing up the R greyscale values, a second sum value obtained by summing up the G greyscale values, and a third sum value obtained by summing up the B greyscale values.

The curve generating circuit may extract from the lookup table one representative brightness level corresponding to one representative brightness range including the representative brightness value and one weighted average brightness range including the weighted average brightness value and generate a brightness adjustment curve using the first reference curve, the second reference curve, and the one representative brightness level.

As described above, according to the present disclosure, an image data processing device generates a brightness adjustment curve appropriately adjusted according to a representative brightness value of an image and adjusts the brightness of each pixel corresponding to the image using the brightness adjustment curve. This allows removing the deterioration of the image quality caused by the conventional uniform brightness adjustment.

In addition, according to the present disclosure, an image data processing device generates a brightness adjustment curve through simple operations. This allows simplifying circuits forming an image data processing device.

BRIEF DESCRIPTION OF THE DRAWINGS

The above and other aspects, features, and advantages of the present disclosure will be more apparent from the following detailed description taken in conjunction with the accompanying drawings, in which:

FIG. 4 is an example of set values according to an embodiment;

FIG. 5 and FIG. 6 are diagrams illustrating calculations of X-axis point values according to an embodiment;

FIG. 7 is an example of a lookup table according to an embodiment;

DETAILED DESCRIPTION

Figure 1:
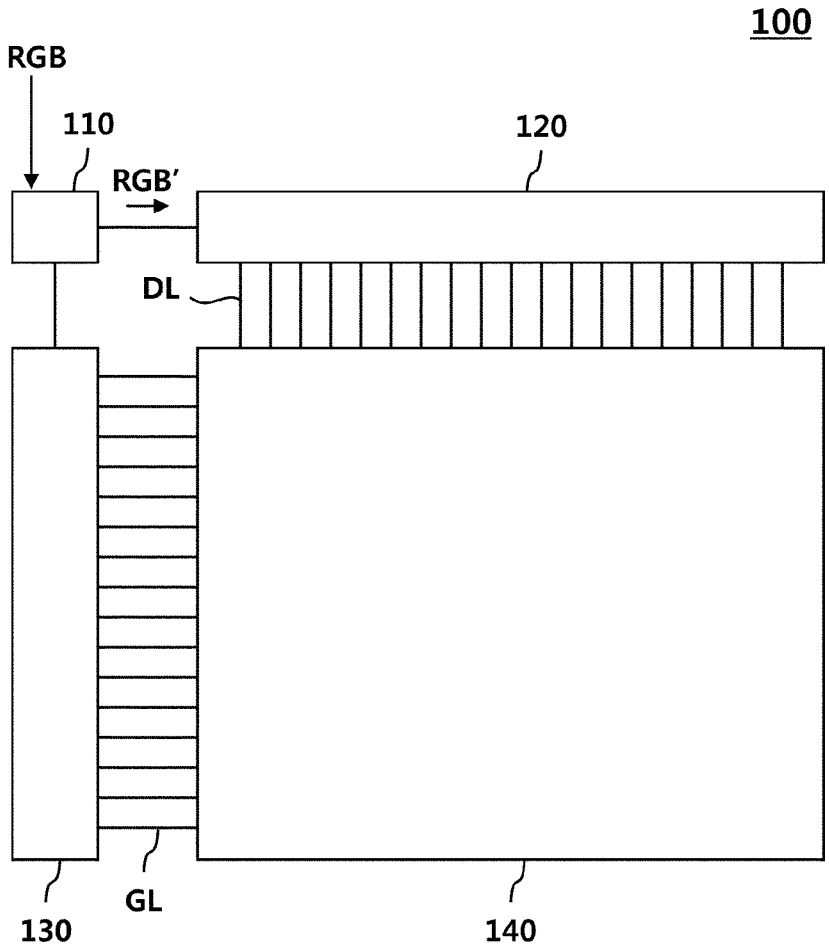
FIG. 1 is a configuration diagram of a display device according to an embodiment.

FIG. 1 is a configuration diagram of a display device 100 according to an embodiment.

Referring to FIG. 1, a display device 100 may comprise an image data processing device 110, a panel driving device 120, a gate driving device 130, and a display panel 140.

The image data processing device 110 may receive input image data RGB from an external device (for example, a host device), convert the input image data RGB into output image data RGB', and transmit the output image data RGB' to the panel driving device 120.

The panel driving device 120 may receive the output image data RGB' from the image data processing device 110 and generate an analog voltage, a so-called data voltage, using the output image data RGB'.

The panel driving device 120 may transmit an analog voltage to each pixel disposed in the display panel 140 through a data line DL.

On the display panel 140, a plurality of pixels may be disposed and each of the plurality of pixels may emit light by itself. For example, each pixel may comprise an organic light emitting diode (OLED) and emit light by itself by a driving current supplied to the organic light emitting diode. The brightness of each pixel may be controlled by an analog voltage supplied from the panel driving device 120.

The gate driving device 130 may supply a scan signal to the display panel 140 through a gate line GL.

According to such a scan signal, a specific line of the display panel 140 may be selected and an analog voltage supplied from the panel driving device 120 may be supplied only to the selected line.

The image data processing device 110 may supply synchronization signals and/or control signals to the panel driving device 120 and the gate driving device 130 so as to control a timing for supplying a scan signal and a timing for supplying an analog voltage.

Such an image data processing device 110 may be referred to as a timing controller, a panel driving device 120 may be referred to as a source driver or a column driver, and a gate driving device 130 may be referred to as a gate driver. Each device may be formed in the form of an independent integrated circuit or at least two devices may be formed in the form of one integrated circuit.

According to an embodiment, the image data processing device 110 may analyze the brightness of an image corresponding to input image data RGB received from an external device (for example, a host device), adjust an input pixel brightness value of the input image data RGB, which corresponds to the brightness of the image, according to the brightness of the image, and transmit output image data RGB' including an output pixel brightness value, obtained by adjusting the input pixel brightness value, to the panel driving device 120.

For this processing, the image data processing device 110 may use an ACL (adaptive current limit or automotive current limit) technique.

A detailed description in this regard is as follows.

Figure 2:
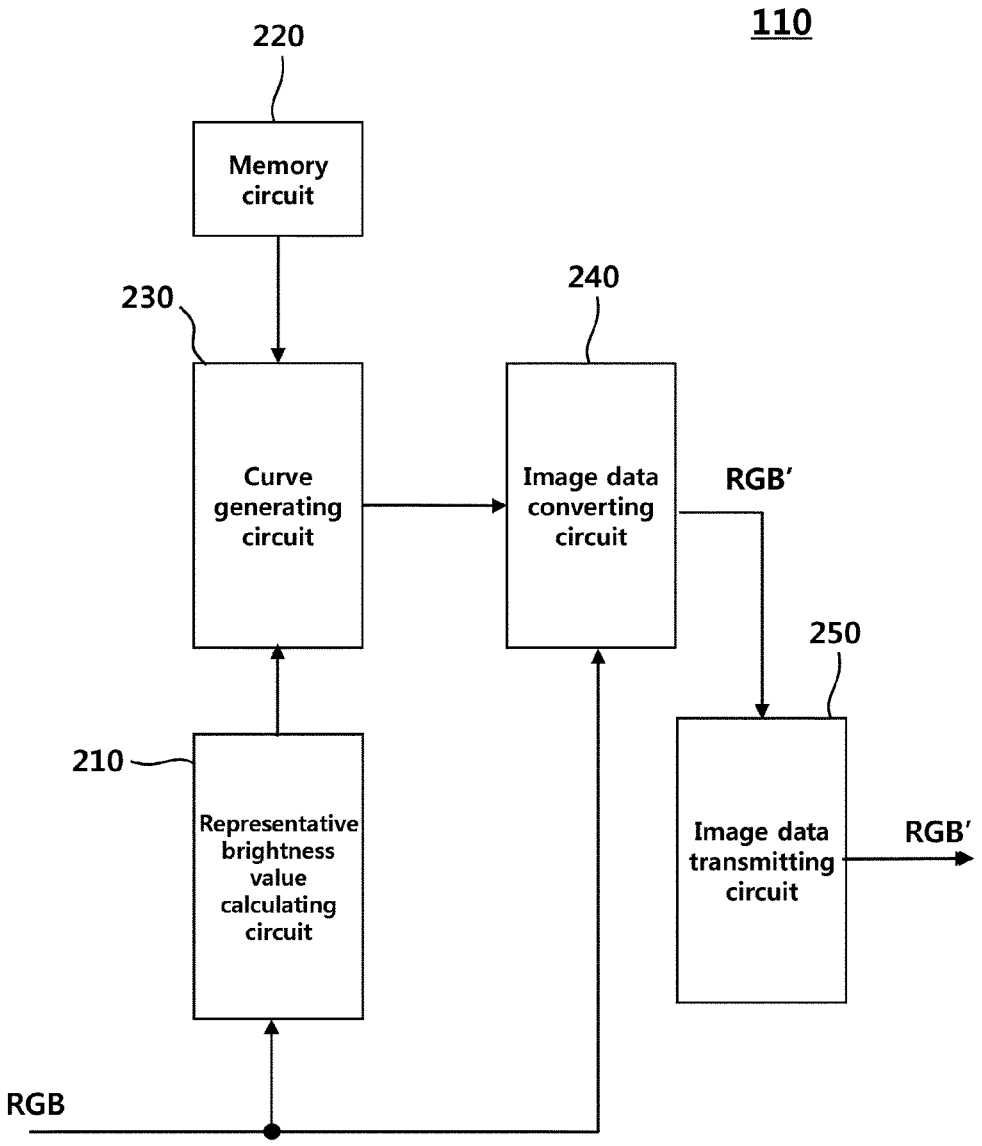
FIG. 2 is a configuration diagram of an image data processing device according to an embodiment.

FIG. 2 is a configuration diagram of an image data processing device 110 according to an embodiment.

Referring to FIG. 2, the image data processing device 110 may comprise a representative brightness value calculating circuit 210, a memory circuit 220, a curve generating circuit 230, an image data converting circuit 240, and an image data transmitting circuit 250 according to one embodiment.

The representative brightness value calculating circuit 210 may calculate a representative brightness value for input pixel brightness values included in input image data RGB. A representative brightness value, which may be referred to as an average picture level (APL), may be calculated by the following equation. Here, the input pixel brightness values may comprise an R greyscale value which is a greyscale value of a red (R) sub-pixel, a G greyscale value which is a greyscale value of a green (G) sub-pixel, and a B greyscale value which is a greyscale value of a blue (B) sub-pixel of a pixel.

$$Y = a \times R \text{ greyscale value} + b \times G \text{ greyscale value} + c \times B \text{ greyscale value} \quad \text{[Equation 1]}$$

$$APL = \text{avg}(Y_1 \sim Y_N) = \frac{Y_1 + Y_2 + \sim + Y_n}{n}$$

Here, the Y may be a pixel greyscale value which is a luminance component for each of a plurality of pixels disposed in the display panel 140, the R greyscale value may be a greyscale value of a red (R) sub-pixel, the G greyscale value may be a greyscale value of a green (G) sub-pixel, the B greyscale value may be a greyscale value of a blue (B) sub-pixel, and the n may be the number of pixels. The a may be a weight for the R greyscale value, the b may be a weight for the G greyscale value, and the c may be a weight for the B greyscale value. Here, a+b+c=1.

The representative brightness value calculating circuit 210 may also calculate a weighted average brightness value for input pixel brightness values.

Specifically, the representative brightness value calculating circuit 210 may calculate a weighted average brightness value for input pixel brightness values by dividing a maximum value, among a first square sum value obtained by summing up squares of R greyscale values, a second square sum value obtained by summing up squares of G greyscale values, and a third square sum value obtained by summing up squares of B greyscale values, by a maximum value, among a first sum value obtained by summing up the R greyscale values, a second sum value obtained by summing up the G greyscale values, and a third sum value obtained by summing up B greyscale values. The weighted average brightness value may be referred to as a weighted average picture level (WAPL).

The memory circuit 220 may store data for generating a brightness adjustment curve in the curve generating circuit 230 which will be described later.

Specifically, the memory circuit 220 may store N set values, N first Y-axis point values, and N second Y-axis point values for generating a brightness adjustment curve. X-axis coordinate values of a brightness adjustment curve may be input brightness values and Y-axis coordinate values thereof may be output brightness values.

According to an embodiment, in order to reduce the size, the memory circuit 220 may not store all X and Y coordinate values for points forming a brightness adjustment curve, but may store only N set values, N first Y-axis point values, and N second Y-axis point values which are data basically required for generating a brightness adjustment curve in the curve generating circuit 230.

Here, the N set values may mean data for calculating N X-axis point values required for generating a brightness adjustment curve in the curve generating circuit 230.

Set values may comprise indexes of involutions of 2 as shown in FIG. 4 and FIG. 5. The reason why the N set values comprise the indexes of the involutions of 2 will be described later when describing the curve generating circuit 230.

Meanwhile, in a case when the representative brightness value calculating circuit 210 calculates a weighted average brightness value for input pixel brightness values, the memory circuit 220 may further store a lookup table as shown in FIG. 7 comprising a plurality of representative brightness ranges, a plurality of weighted average brightness ranges, and a plurality of representative brightness levels corresponding to the plurality of representative brightness ranges and the plurality of weighted average brightness ranges.

The curve generating circuit 230 may generate a brightness adjustment curve for adjusting input pixel brightness values of input image data.

Specifically, the curve generating circuit 230 may calculate N X-axis point values using N set values.

According to an embodiment, the curve generating circuit 230 may calculate, by shift operations, a first involution value to an Nth involution value which are values of the involutions of 2 using the N set values as indexes.

For example, as shown in FIG. 4, in a case when there are 8 set values which are from point 1 set value through point 8 set value and the point 8 set value is 5, the curve generating circuit 230 may obtain the binary number "00010000" corresponding to the decimal number "32", which is 2 to the power of 5, by shifting 1 in the binary number "00000001" to the left by 5.

After calculating the first through the Nth involution values, the curve generating circuit 230 may primarily calculate Nth X-axis point value by subtracting the Nth involution value from a predetermined highest brightness value of a pixel as shown in FIG. 5.

Secondly, the curve generating circuit 230 may calculate an N−1th X-axis point value by subtracting an N-th involution value from the Nth X-axis point value.

In this way, the curve generating circuit 230 may subsequently calculate an N−2th X-axis point value through a first X-axis point value.

In other words, the curve generating circuit 230 may calculate the N X-axis point values in an order in which one corresponding to the highest brightness value is firstly calculated and one corresponding to the lowest brightness value is lastly calculated.

For example, in a case when the N set values are as shown in FIG. 4, the curve generating circuit 230 may primarily calculate an $8^{th}$ X-axis point value "991" corresponding to the highest brightness value and subsequently calculate the other X-axis point values in order of the size of the corresponding brightness value.

According to an embodiment, the curve generating circuit 230 calculates the X-axis point values using shift operations and subtracting operations. This allows simplifying circuits forming the curve generating circuit 230.

Figure 8:
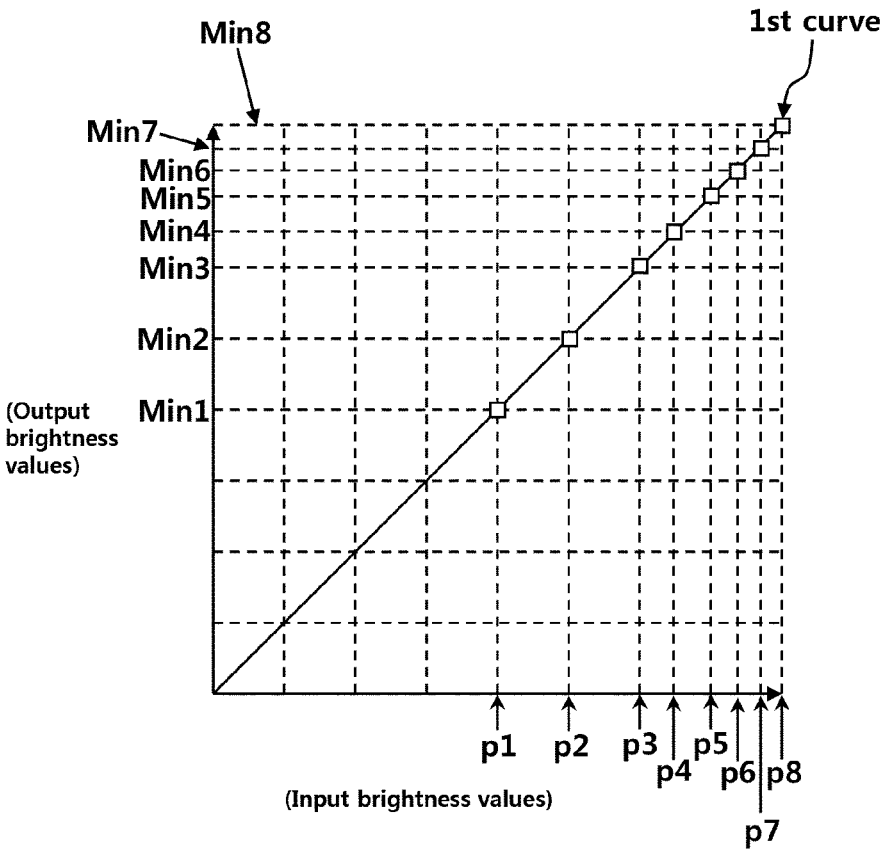
FIG. 8 is a diagram illustrating the generation of a first reference curve according to an embodiment.

Meanwhile, the curve generating circuit 230 may match the N X-axis point values calculated as described above with N first Y-axis point values (Min1 to Min8 in FIG. 8) stored in the memory circuit 220 (see rectangular points in FIG. 8).

After matching, the curve generating circuit 230 may calculate values between every two adjacent ones of the N X-axis point values by a data interpolation so as to generate a first reference curve as shown in FIG. 8.

Figure 9:
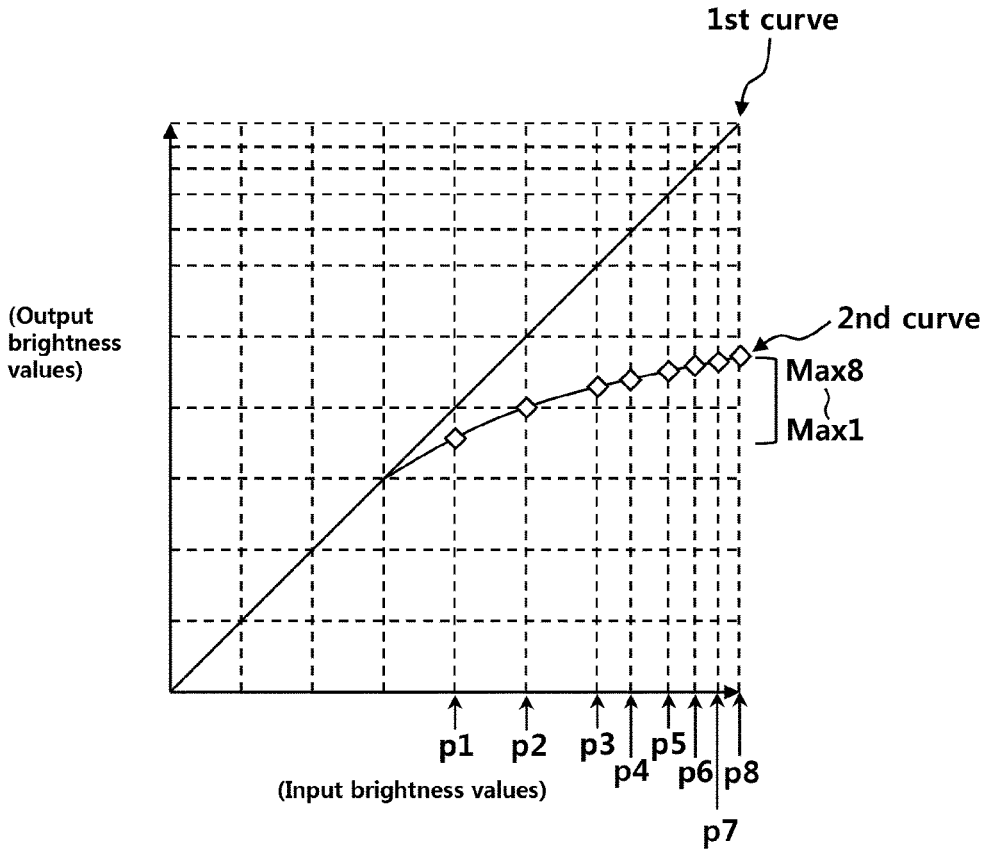
FIG. 9 is a diagram illustrating the generation of a second reference curve according to an embodiment.

In addition, the curve generating circuit 230 may match the N X-axis point values with N second Y-axis point values (Max1 to Max8 in FIG. 9) stored in the memory circuit 220 (see lozenge-shaped points in FIG. 9).

After matching, the curve generating circuit 230 may calculate values between the N X-axis point values by the data interpolation so as to generate a second reference curve as shown in FIG. 9.

Here, the first reference curve and the second reference curve may be a minimum reference for adjustment and a maximum reference for adjustment required for generating a brightness adjustment curve reflecting a representative brightness value.

After generating the first reference curve and the second reference curve, the curve generating circuit 230 may generate a brightness adjustment curve by a data interpolation using a first representative brightness value identified in the first reference curve, a second representative brightness value identified in the second reference curve, and a representative brightness value. The first representative brightness value and the second representative brightness value may be stored in the memory circuit 220. Here, the representative brightness value may be less than or equal to the first representative brightness value and equal to or greater than the second representative brightness value.

In an embodiment, an Nth Y-axis point value, matched with the Nth X-axis point value for the brightness adjustment curve, may be calculated by an interpolation equation as follows.

$$\frac{[\text{Max}.N \times (Rv.B - Rv.B_1)] + [\text{Min}.N \times (Rv.B_2 - Rv.B)]}{(Rv.B - Rv.B_1) + (Rv.B_2 - Rv.B)} \quad \text{[Equation 2]}$$

Here, the Max.N may be an Nth second Y-axis point value, the Rv.B may be a representative brightness value, the $Rv.B_1$ may be a first representative brightness value, the Min.N may be an Nth first Y-axis point value, and the $Rv.B_2$ may be a second representative brightness value.

Figure 10:
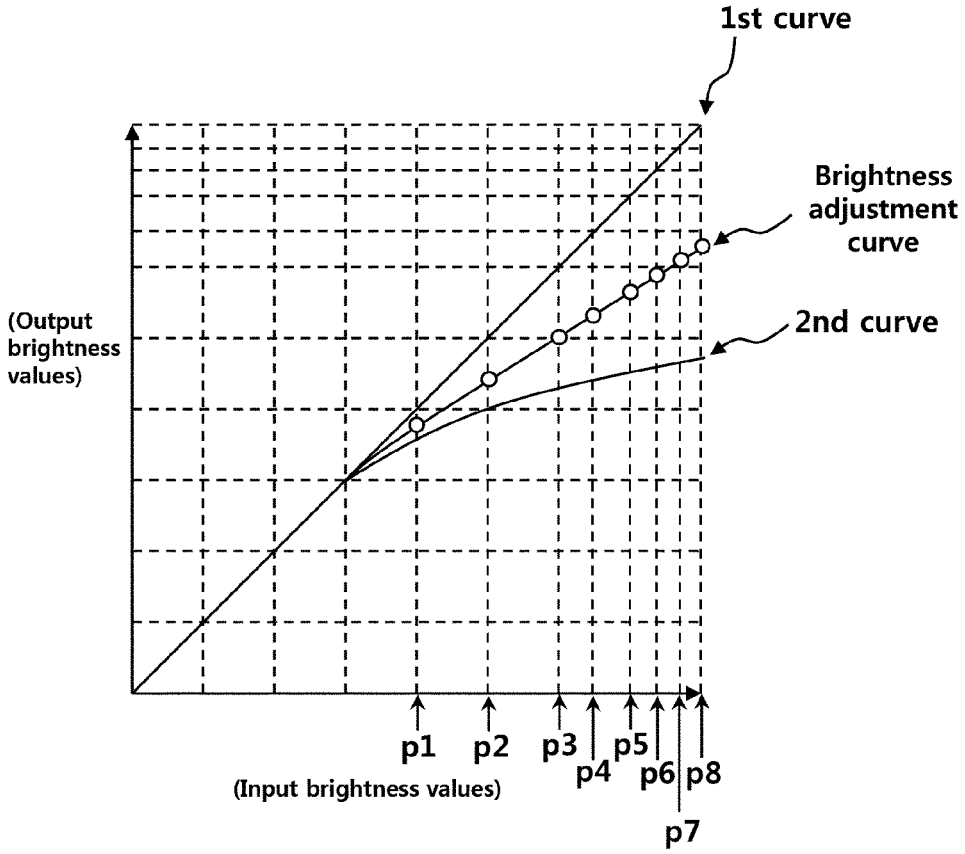
FIG. 10 is a diagram illustrating the generation of a brightness adjustment curve according to an embodiment.

The curve generating circuit 230 may calculate N Y-axis point values for a brightness adjustment curve using the aforementioned interpolation equation. Subsequently, values between N X-axis points values matched with the N Y-axis point values (see circular points in FIG. 10) may be calculated by the data interpolation so as to generate a brightness adjustment curve as shown in FIG. 10.

Meanwhile, in a case when the representative brightness value calculating circuit 210 calculates a weighted average brightness value for input pixel brightness values and the memory circuit 220 further store a lookup table similar to the lookup table shown in FIG. 7, the curve generating circuit 230 may extract one representative brightness level corresponding to one representative brightness range and one weighted average brightness range. Here, one representative brightness range may a representative brightness range including a representative brightness value and one weighted average brightness range may be a weighted average brightness range including a weighted average brightness value.

The curve generating circuit 230 may also generate a brightness adjustment curve using the first reference curve, the second reference curve, and one average brightness level.

In other words, a first representative brightness level may be applied to the first reference curve and a second representative brightness level may be applied to the second reference curve, and the curve generating circuit 230 may generate a brightness adjustment curve by a data interpolation using the first representative brightness level, the second representative brightness level, and one average brightness level.

As described above, according to an embodiment, the curve generating circuit 230 may appropriately adjust the brightness adjustment curve according to a representative brightness value of input image data RGB, that is, a representative brightness value for input pixel brightness values included in the input image data RGB.

The image data converting circuit 240 may convert an input pixel brightness value into an output pixel brightness value using the brightness adjustment curve.

Figure 11:
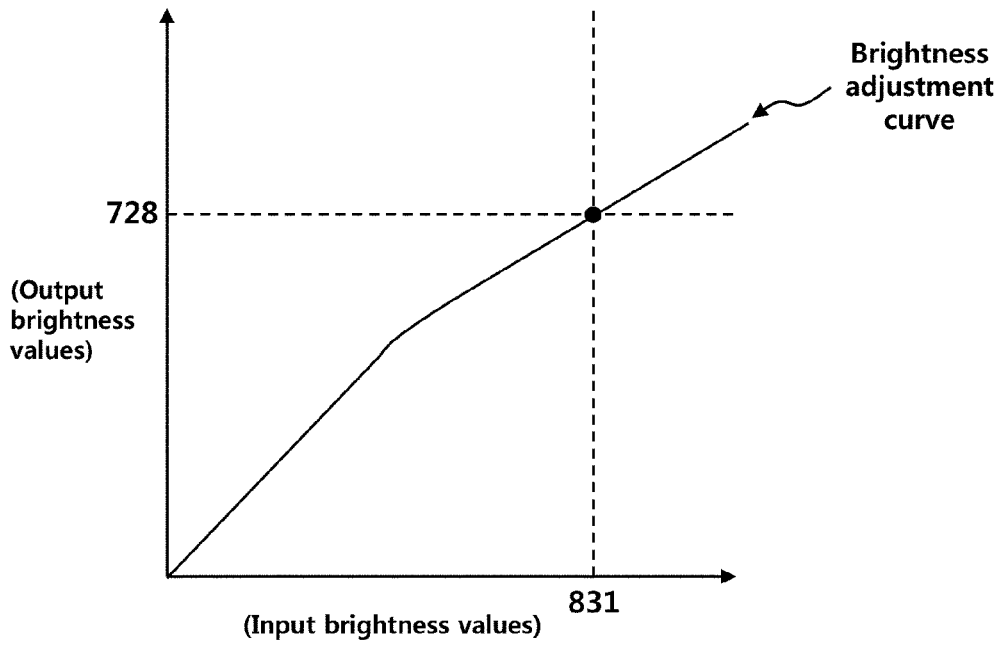
FIG. 11 is a diagram illustrating a conversion of an input pixel brightness value using a brightness adjustment curve.

For example, if an input pixel brightness value included in input image data RGB is 831, the image data converting circuit 240 may convert the input pixel brightness value 831 into an output pixel brightness value 728 by applying the input pixel brightness value 831 to the brightness adjustment curve as shown in FIG. 11.

After converting all input pixel brightness values included in the input image data RGB into output pixel brightness values, the image data converting circuit 240 may transfer output image data RGB' including the output pixel brightness values to the image data transmitting circuit 250.

The image data transmitting circuit 250 may transmit the output image data RGB' to the panel driving device 120.

According to an embodiment, the calculation of a representative brightness value and the generation of a brightness adjustment curve resulting from it may be performed by frame of image data.

In other words, whenever receiving input image data RGB by frame from the image data processing device 110, the representative brightness value calculating circuit 210 may calculate a representative brightness value and, accordingly, the curve generating circuit 230 may generate a brightness adjustment curve.

Here, if a representative brightness value in a current frame greatly changes in comparison with a representative brightness value in a previous frame, the brightness of the display device 100 may greatly changes and this may cause discomfort to a user looking at the display device 100.

In order to remove such a problem, a dimming method to alleviate a sudden change may be applied.

Hereinafter, a detailed configuration of the curve generating circuit 230 will be described.

Figure 3:
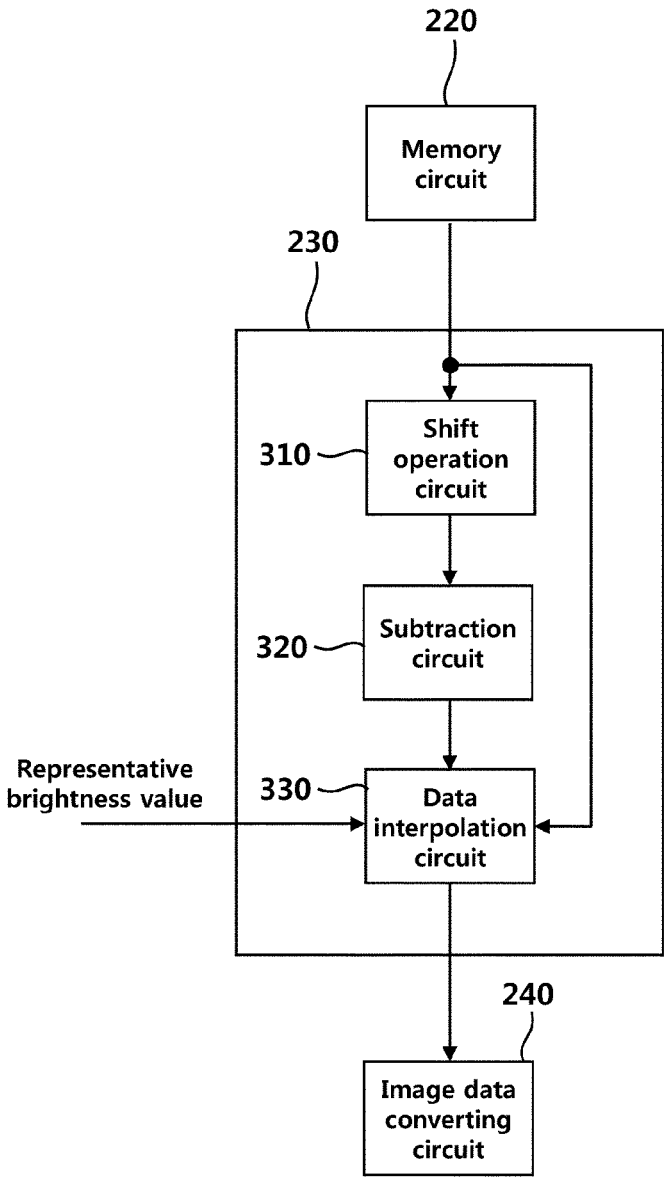
FIG. 3 is a configuration diagram of a curve generating circuit according to an embodiment.

FIG. 3 is a configuration diagram of a curve generating circuit 230 according to an embodiment Referring to FIG. 3, the curve generating circuit 230 may comprise a shift operation circuit 310, a subtraction circuit 320, and a data interpolation circuit 330.

The shift operation circuit 310 may calculate by shift operations a first involution value to an Nth involution value, which are values of the involutions of 2 having N set values as indexes.

For example, in a case when the N set values comprise 8 set values which are from point 1 set value to point 8 set value and the point 8 set value is 5 as shown in FIG. 4, the shift operation circuit 310 may obtain the binary number "00010000" corresponding to the decimal number "32", which is 2 to the power of 5, by shifting 1 in the binary number "00000001" to the left by 5.

The subtraction circuit 320 may calculate an Nth X-axis point value by subtracting an Nth involution value from a predetermined highest brightness value of a pixel and calculate an N−1th X-axis point value by subtracting an N−1th involution value from the Nth X-axis point value.

In other words, when calculating N X-axis point values, the subtraction circuit 320 may calculate in sequence a point value corresponding to the highest brightness value through a point value corresponding to the lowest brightness value by subtracting operations.

The data interpolation circuit 330 may match the N X-axis point values with the N first Y-axis point values stored in the memory circuit 220, and then, calculate values between the N X-axis point values by the data interpolation. In this way, the data interpolation circuit 330 may generate a first reference curve as shown in FIG. 8.

In addition, the data interpolation circuit 330 may match the N X-axis point values with the N second Y-axis point values stored in the memory circuit 220, and then, calculate values between the N X-axis point values by the data interpolation. In this way, the data interpolation circuit 330 may generate a second reference curve as shown in FIG. 9.

After generating the first reference curve and the second reference curve, the data interpolation circuit 330 may generate a brightness adjustment curve by a data interpolation using a first representative brightness value identified in the first reference curve, a second representative brightness value identified in the second reference curve, a representative brightness value. The first representative brightness value and the second representative brightness value may be stored in the memory circuit 220. Here, the representative value may be less than or equal to the first representative brightness value and equal to or greater than the second representative brightness value.

The data interpolation circuit 330 may calculate N Y-axis point values for the brightness adjustment curve using the aforementioned equation for interpolation (Equation 2). In addition, the data interpolation circuit 330 may calculate values between N X-axis point values matched (see circular points in FIG. 10) with the N Y-axis point values by the data interpolation to generate a brightness adjustment curve as shown in FIG. 10.

Meanwhile, in a case when the representative brightness value calculating circuit 210 calculates a weighted average brightness value for input pixel brightness values and the memory circuit 220 further store a lookup table similar to the lookup table shown in FIG. 7, the data interpolation circuit 330 may extract one representative brightness level corresponding to one representative brightness range and one weighted average brightness range. Here, one representative brightness range may be a representative brightness range including a representative brightness value and one weighted average brightness range may be a weighted average brightness range including a weighted average brightness value.

The data interpolation circuit 330 may also generate a brightness adjustment curve using the first reference curve, the second reference curve, and one average brightness level.

In other words, a first representative brightness level may be applied to the first reference curve and a second representative brightness level may be applied to the second reference curve, and the data interpolation circuit 330 may generate a brightness adjustment curve by a data interpolation using the first representative brightness level, the second representative brightness level, and one average brightness level.

Hereinafter, a procedure of processing image data in the image data processing device 110 will be described.

Figure 12:
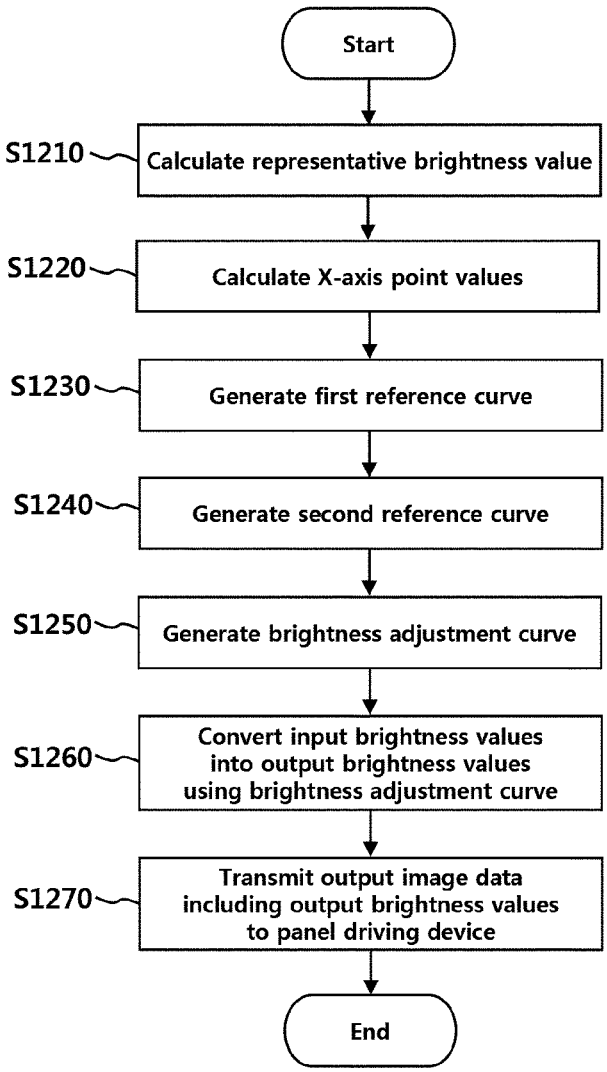
FIG. 12 is a flow diagram illustrating a procedure of processing image data in an image data processing device.

FIG. 12 is a flow diagram illustrating a procedure of processing image data in an image data processing device 110 according to one embodiment.

Referring to FIG. 12, the image data processing device 110 may receive input image data RGB from a host device and calculate a representative brightness value for input pixel brightness values included in the input image data RGB (S1210). Here, a representative brightness value may be referred to as an average picture level (APL) and the input pixel brightness values may comprise R greyscale values which are greyscale values of red (R) sub-pixels, G greyscale values which are greyscale values of green (G) sub-pixels, and B greyscale values which are greyscale values of blue (B) sub-pixels. The image data processing device 110 may calculate the representative brightness value using the aforementioned equation 1.

After calculating the representative brightness value, the image data processing device 110 may calculate N X-axis point values using previously stored N set values (S1220). Here, the image data processing device 110 may calculate the N X-axis point values, by the shift operations and the subtraction operations using the N set values, starting from an Nth X-axis point value.

Subsequently, the image data processing device 110 may match the N X-axis point values with previously stored N first Y-axis point values and calculate values between the N X-axis point values to generate a first reference curve (S1230).

The image data processing device 110 may match the N X-axis point values with previously stored N second Y-axis point values and calculate values between the N X-axis point values to generate a second reference curve (S1240). Here, the order of generating the first reference curve and the second reference curve may be determined by a designer of the image data processing device 110.

The image data processing device 110 may subsequently generate a brightness adjustment curve by a data interpolation using a first representative brightness value identified in the first reference curve, a second representative brightness value identified in the second reference curve, and a representative brightness value (S1250). Here, the representative brightness value may be less than or equal to the first representative brightness value and equal to or greater than the second representative brightness value.

The image data processing device 110 may convert the input pixel brightness values into output pixel brightness values using the brightness adjustment curve and transmit output image data RGB' including the output pixel brightness values to the panel driving device (S1260, S1270).

In S1210, the image data processing device 110 may further calculate a weighted average brightness value for the input pixel brightness values.

In this case, the image data processing device 110 may further store a lookup table similar to that in FIG. 7. After S1240, the image data processing device 110 may extract from the lookup table one representative brightness level corresponding to one representative brightness range including a representative brightness value and one weighted average brightness range including a weighted average brightness value.

The image data processing device 110 may also generate a brightness adjustment curve using the first reference curve, the second reference curve, and one representative brightness level.

As described above, according to the present disclosure, the image data processing device 110 generates a brightness adjustment curve appropriately adjusted according to a representative brightness value of an image and adjust the brightness of each pixel included in the image. This allows removing the deterioration of the image quality due to a conventional uniform adjustment of brightness.

In addition, since the image data processing device 110 generates the brightness adjustment curve using the shift operation, the subtraction operation, and the data interpolation, circuits forming the image data processing device 110 may be simplified.

While particular embodiments and applications have been illustrated and described, it is to be understood that the invention is not limited to the precise construction and components disclosed herein and that various modifications, changes and variations which will be apparent to those skilled in the art may be made in the arrangement, operation and details of the method and apparatus disclosed herein without departing from the spirit and scope of the present disclosure.

What is claimed is:

1. A method of processing image data by a processing device, the method comprising:

calculating a representative brightness value for input pixel brightness values included input image data;

calculating N (N is a natural value, which is 2 or higher) X-axis point values using N set values;

generating a first reference curve using N first Y-axis point values and the X-axis point values and generating a second reference curve using N second Y-axis point values and the X-axis point values;

generating a brightness adjustment curve using the first reference curve, the second reference curve, and the representative brightness value; and converting the input pixel brightness values into output pixel brightness values using the brightness adjustment curve, wherein the set values comprise indexes of involutions of 2, wherein calculating the X-axis point values comprises calculating an Nth involution value, which is a value of the involution of 2 having an Nth set value as an index, by an operation of shift by the Nth set value, which is a last set value, and calculating an Nth X-axis point value, which is a maximum X-axis point value, by subtracting the Nth involution value from a highest brightness value of a pixel.

2. The method of processing image data of claim 1, further comprising a step of transmitting output image data including the output pixel brightness values to a panel driving device.

3. The method of processing image data of claim 1, wherein the input pixel brightness values, the X-axis point values, the first Y-axis point values, the second Y-axis point values, and the output pixel brightness values are greyscale values.

4. The method of processing image data of claim 1, wherein X-axis coordinate values of the brightness adjustment curve comprise the input pixel brightness values and Y-axis coordinate values of the brightness adjustment curve comprise the output pixel brightness values.

5. The method of processing image data of claim 1, wherein generating the first reference curve and the second reference curve comprises: generating a first reference curve by matching the X-axis point values with the first Y-axis point values and calculating values between the X-axis point values by a data interpolation; and generating a second reference curve by matching the X-axis point values with the second Y-axis point values and calculating values between the X-axis point values by the data interpolation.

6. The method of processing image data of claim 1, wherein the representative brightness value is less than or equal to a first representative brightness value identified in the first reference curve and equal to or greater than a second representative brightness value identified in the second reference curve.

7. The method of processing image data of claim 6, wherein, the brightness adjustment curve is generated by a data interpolation using the first representative brightness value, the second representative brightness value, and the representative brightness value.

8. An image data processing device, comprising:

a representative brightness value calculating circuit to calculate a representative brightness value for input pixel brightness values included in input image data;

a curve generating circuit to generate a first reference curve by calculating N (N is a natural number, which is 2 or higher) X-axis point values using N set values and using N first Y-axis point values and the N X-axis point values, to generate a second reference curve using N second Y-axis point values and the N X-axis point values, and to generate a brightness adjustment curve using the first reference curve, the second reference curve, and the representative brightness value; and an image data converting circuit to convert the input pixel brightness values into output pixel brightness values using the brightness adjustment curve, wherein the curve generating circuit comprises:

a shift operation circuit to calculate values of involutions of 2 having the N set values as indexes by shift operations;

a subtraction circuit to calculate an Nth X-axis point value, which is a maximum X-axis point value, by subtracting an Nth involution value, which is a value of involution of 2 having an Nth set value (a last set value among the N set values) as an index, from a highest brightness value of a pixel and to calculate an N−1th X-axis point value by subtracting an N−1th involution value from the Nth X-axis point value; and a data interpolation circuit to generate the first reference curve by matching the X-axis point values with the first Y-axis point values and calculating values between the X-axis point values and to generate the second reference curve by matching the X-axis point values with the second Y-axis point values and calculating values between the X-axis point values.

9. The image data processing device of claim 8, further comprising an image data transmitting circuit to transmit output image data including the output pixel brightness values to a panel driving device.

10. The image data processing device of claim 8, wherein the data interpolation circuit generates the brightness adjustment curve by a data interpolation using a first representative brightness value identified in the first reference curve, a second representative brightness value identified in the second reference curve, and the representative brightness value.

11. An image data processing device, comprising:

a representative brightness value calculating circuit to calculate a representative brightness value for input pixel brightness values included in input image data;

a curve generating circuit to generate a first reference curve by calculating N (N is a natural number, which is 2 or higher) X-axis point values using N set values and using N first Y-axis point values and the N X-axis point values, to generate a second reference curve using N second Y-axis point values and the N X-axis point values, and to generate a brightness adjustment curve using the first reference curve, the second reference curve, and the representative brightness value;

an image data converting circuit to convert the input pixel brightness values into output pixel brightness values using the brightness adjustment curve; and a memory circuit to store the N set values, the N first Y-axis point values, and the N second Y-axis point values, wherein the memory circuit further stores a lookup table including a plurality of representative brightness ranges, a plurality of weighted average brightness ranges, and a plurality of representative brightness levels corresponding to the plurality of representative brightness ranges and the plurality of weighted average brightness ranges, wherein the input pixel brightness values comprise R greyscale values, which are greyscale values of red (R) sub-pixels, G greyscale values, which are greyscale values of green (G) sub-pixels, and B greyscale values, which are greyscale values of blue (B) sub-pixels and the representative brightness value calculating circuit calculates a weighted average brightness value by dividing a maximum value, among a first square sum value obtained by summing up square values of the R greyscale values, a second square sum value obtained by summing up square values of the G greyscale values, and a third square sum value obtained by summing up square values of the B greyscale values, by a maximum value among a first sum value obtained by summing up the R greyscale values, a second sum value obtained by summing up the G greyscale values, and a third sum value obtained by summing up the B greyscale values.

12. The image data processing device of claim 11, wherein the curve generating circuit extracts from the lookup table one representative brightness level corresponding to one representative brightness range including the representative brightness value and one weighted average brightness range including the weighted average brightness value and generates a brightness adjustment curve using the first reference curve, the second reference curve, and the one representative brightness level.

* * * * *